US006412300B2

(12) United States Patent
Kaposi

(10) Patent No.: US 6,412,300 B2
(45) Date of Patent: Jul. 2, 2002

(54) STAY COLD BEVERAGE VESSEL

(75) Inventor: Sascha Kaposi, Seattle, WA (US)

(73) Assignee: Progressive International Corp., Kent, WA (US)

( * ) Notice: Subject to any disclaimer, the term of this patent is extended or adjusted under 35 U.S.C. 154(b) by 0 days.

(21) Appl. No.: 09/758,964

(22) Filed: Jan. 11, 2001

Related U.S. Application Data

(60) Provisional application No. 60/175,410, filed on Jan. 10, 2000.

(51) Int. Cl.[7] ..... F25D 3/08

(52) U.S. Cl. ..... 62/457.3; 62/457.4; 62/457.2

(58) Field of Search ..... 62/457.1, 457.2, 62/457.3, 457.4, 371, 530, 457.8

(56) References Cited

U.S. PATENT DOCUMENTS 2,952,133 A * 9/1960 Miller ..... 62/457
4,882,914 A * 11/1989 Haines-Keeley et al. .. 62/457.4
5,406,808 A * 4/1995 Babb et al. ..... 62/457.4

* cited by examiner

*Primary Examiner*—Henry Bennett
*Assistant Examiner*—Melvin Jones
(74) *Attorney, Agent, or Firm*—John R. Benefiel

(57) ABSTRACT

A stay cool beverage container having a series of radially projecting vertical ribs spaced about the perimeter at the level of a perimeter cavity filled with a refrigerant gel, the ribs gripped by the person holding the drinking vessel, and reducing heat gain into the drink vessel as well as minimizing the sensation of cold felt in the user's fingers and insuring a more secure grip.

8 Claims, 3 Drawing Sheets

STAY COLD BEVERAGE VESSEL

CROSS REFERENCE TO RELATED APPLICATION

This application claims the benefit of U.S. provisional Ser. No. 60/175,410, filed on Jan. 10, 2000.

BACKGROUND OF THE INVENTION

This invention concerns drinking vessels and more particularly drinking vessels designed to keep a chilled beverage cold during the period when the beverage is being consumed by a user of the vessel. Insulated jackets have been used in the past, but in seeking further improvements in keeping the beverage cold, beverage vessels have been provided with a surrounding space filled with a "refrigerant gel". The vessel is kept in a refrigerator or freezer to chill the gel prior to use. When a cooled beverage is poured into the vessel, the gel acts to absorb heat from the beverage to maintain its cold condition over an extended period of time.

U.S. Pat. No. 5,001,907 describes such a vessel comprising a mug having a large handle which keeps the fingers from contacting the cold walls of the vessel, and insuring a secure grip.

Heretofore, this "stay cool" design has not been employed in drinking vessels other than mugs due to the unpleasantness associated with directly grasping the outer wall of a drinking vessel which is chilled by such refrigerant gel. Also, body heat conducted through the fingers when the vessel walls directly grip the vessel would tend to warm the beverage. The outer wall would also be slippery and hard to handle securely when the grasped surfaces are chilled.

It is the object of the present invention to provide a drinking vessel which has a "stay cool" outer wall which may be directly and securely gripped by a user without discomfort despite its low temperature condition, and which minimizes warming of the liquid by body heat.

SUMMARY OF THE INVENTION

This object and others which will become apparent upon a reading of the following specification and claims are achieved by providing a series of widely spaced ribs projecting radially from the exterior perimeter wall defining a cavity containing the refrigerant gel. The ribs eliminates the discomfort otherwise experienced when the gel is chilled to keep the vessel's contents cool, and also reduces the transfer of heat from the holder's hand into the vessel.

In addition, the ribs enable a more secure gripping of the vessel.

The vessel is preferably constructed by nesting an inner transparent plastic beverage container piece into a plastic outer holder piece formed with the exterior ribs, and fixing the same together as by ultrasonic welding. The exterior of the beverage container piece and the interior of the holder piece are offset to define an annular cavity receiving the refrigerant gel.

DETAILED DESCRIPTION

Figure 1:
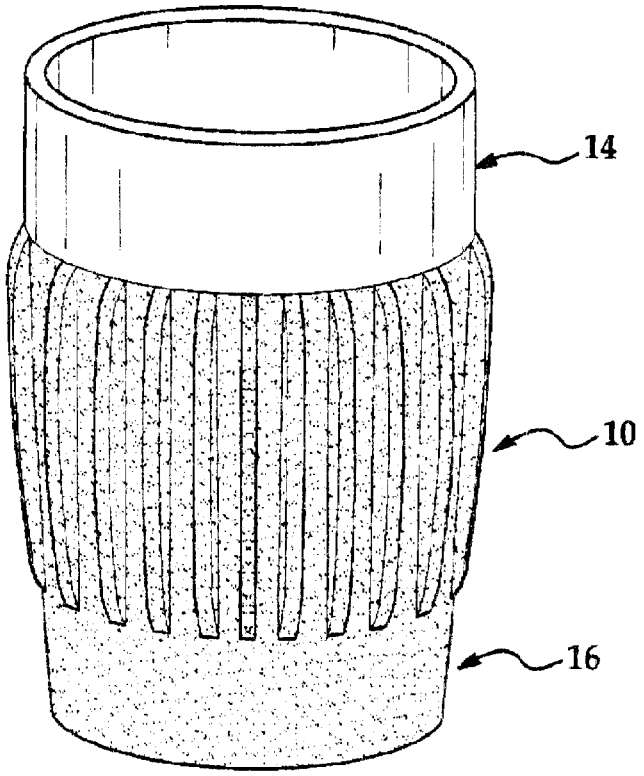
FIG. 1 is a perspective view of a stay cool drinking vessel according to the invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, in particular FIGS. 1–4, a drinking vessel 10 according to the invention is shown, taking the form of a generally medium sized cylindrical tumbler.

Figure 2:
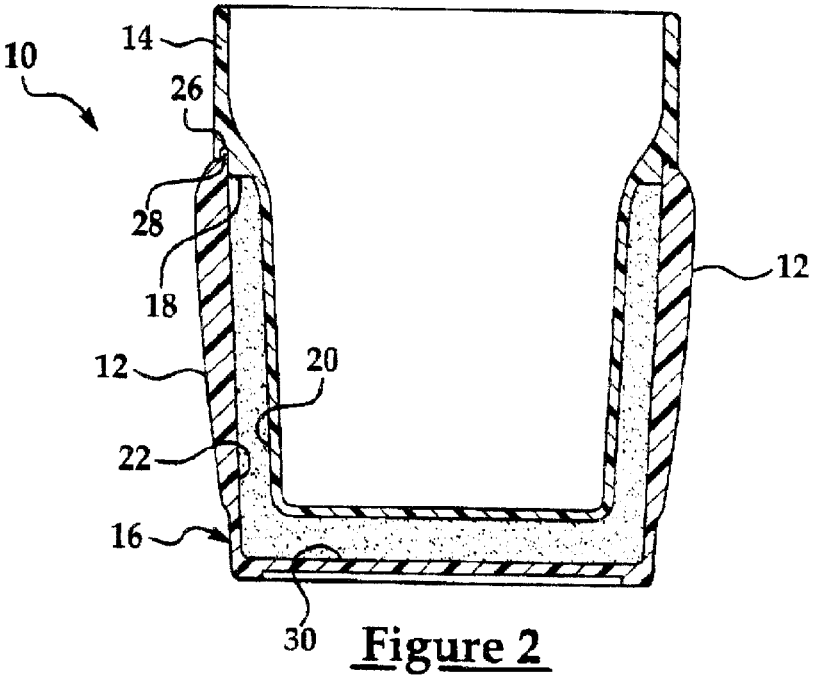
FIG. 2 is a sectional view of the drinking vessel shown in FIG. 1.
Figure 3:
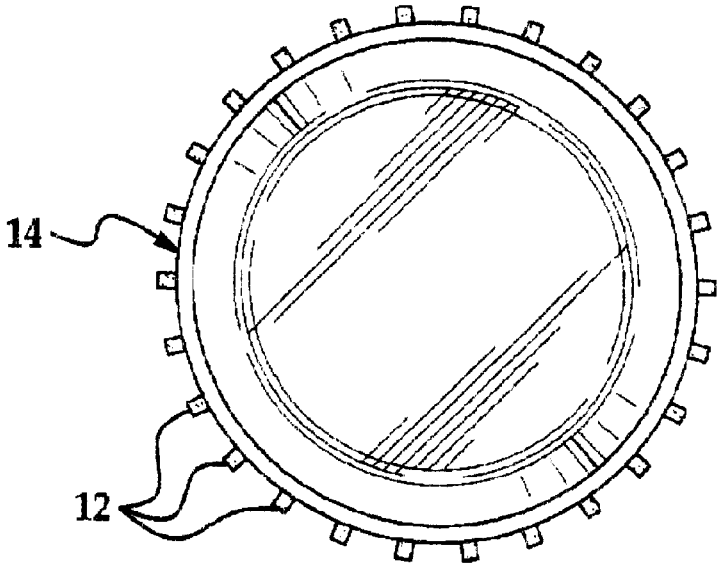
FIG. 3 is a top view of the drinking vessel shown in FIGS. 1 and 2.
Figure 4:
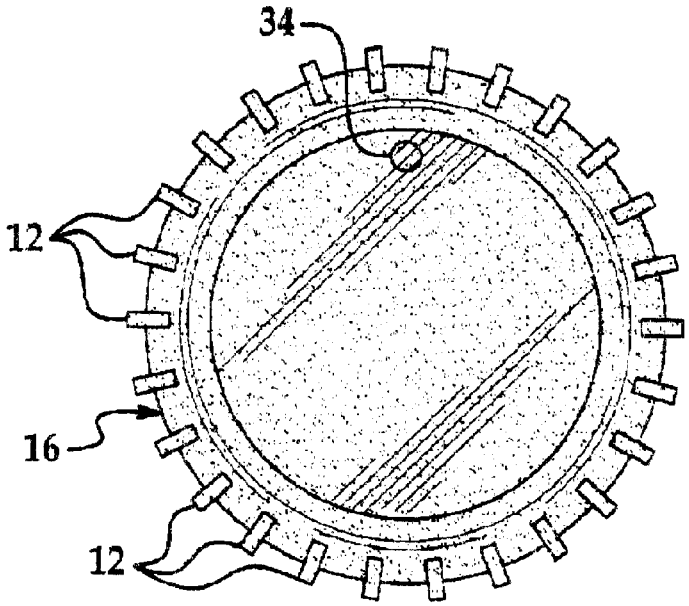
FIG. 4 is a bottom view of the drinking vessel shown in FIGS. 1–3.

The exterior midsection is formed with a series of relatively widely spaced ribs 12 projecting radially outwardly and extending vertically in an up and down direction. The ribs 12 are preferably thin, i.e., 0.25 cm thick and widely spaced, i.e., 26 rib spaced at 14° intervals around an approximately 8.5 cm diameter tumbler so as to minimize the area of contact with the fingers of a person holding the vessel. The spaces between the ribs 12 is much wider than the thickness of the ribs 12, so that the area of contact with the finger is much less than it would otherwise be. The ribs 12 are radiused at the top and taper down their length as best seen in FIG. 2, for aesthetic purposes and to improve the ease of gripping the tumbler.

The drinking vessel 10 shown is of two piece construction, including an inner beverage container piece 14, and an outer holder piece 16, the container piece 14 nested into the holder piece 16, with the upper end of the container piece 16 projecting above the holder piece to be exposed for a distance of several centimeters of its height. This makes it easier to observe the contents, as the container piece 14 is preferably of transparent plastic.

The container piece 14 has step or shoulder 18 to create an offset to form an annular axially extending space between the exterior 20 of the container 14 and the inside 22 of the holder piece 16. The holder piece 16 has an upper rim 26 received in a groove 28 in the shoulder 18 of the container piece 14 located to suspend the container piece 14 above the bottom 30 of the holder piece 16. The cavity defined therebetween extends across the bottom the vessel 10.

A volume of a refrigerant gel 32 is loaded into the cavity as through a hole 34 in the bottom wall of the holder piece 16 and sealed to permanently be filled with the gel. Suitable such refrigerant gels are well known, as described in U.S. Pat. No. 5,001,907 and other patents referenced.

The relatively thin and widely spaced ribs 12 minimize the area of contact with the fingers of a person gripping the vessel 10. This minimizes the heating of the container piece 14 by the conduction of heat into from the fingers, and also minimizes the sensation of cold experienced in the fingers of the person gripping the same. At the same time, the grip is made more secure by the presence of the ribs 12.

The beverage vessel 10 is first chilled as by being placed in a refrigerator or freezer. The gel has a high heat capacity such as to absorb heat from the surroundings and only very slowly rise in temperature, tending to substantially slow the warming of a cold beverage poured into the container piece 14.

The outer holder piece 16 and container piece 14 may be molded from a suitable plastic, the container piece 14 preferably transparent as noted above and the holder piece 16 desirably of a colored translucent or opaque plastic.

Figure 5:
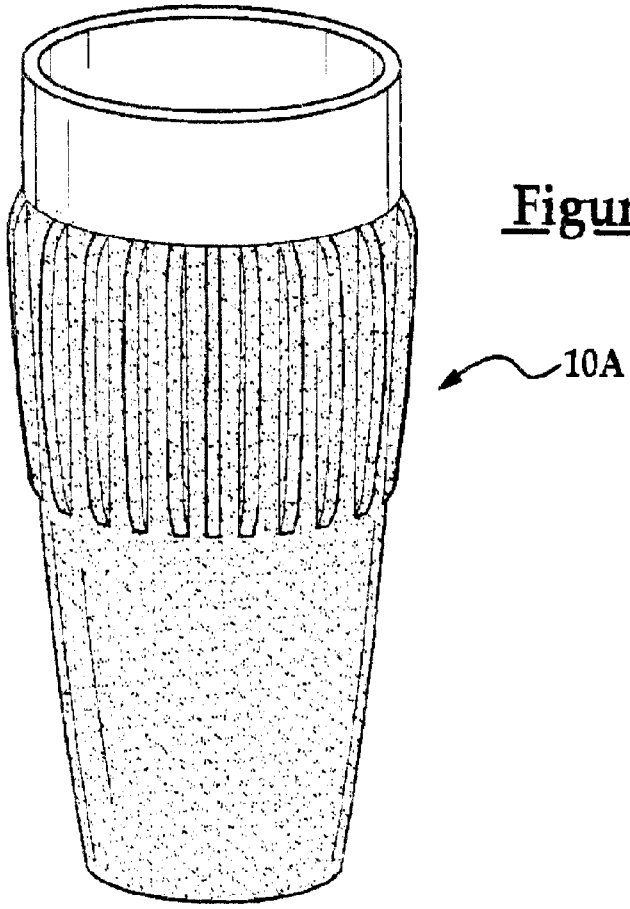
FIG. 5 is a perspective view of a tall tumbler form of the drinking vessel according to the invention.
Figure 6:
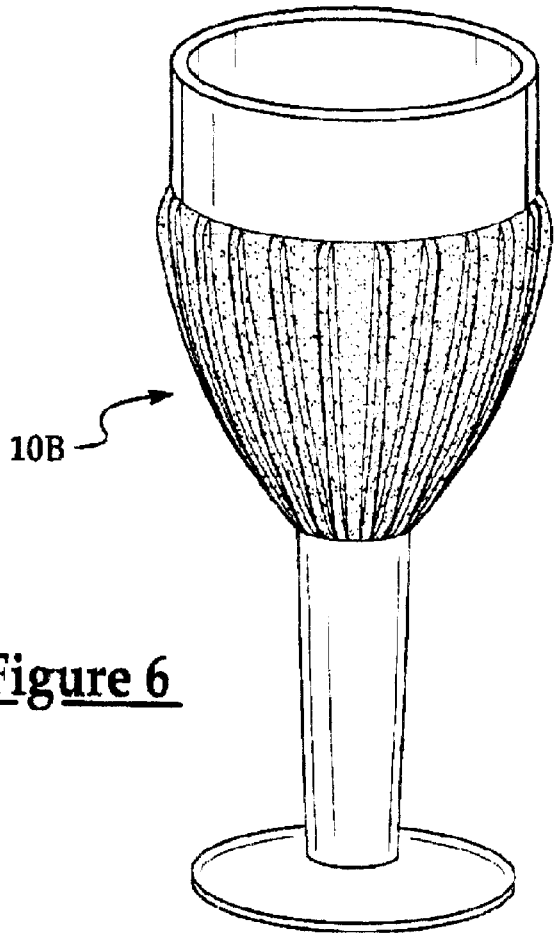
FIG. 6 is a perspective view of a stemware form of the drinking vessel according to the invention.

FIG. 5 shows a tall tumbler 10A as an alternate embodiment of a invention, while FIG. 6 shows a stemware drinking vessel 10B as yet another embodiment.

What is claimed is:

1. A stay cold drinking vessel, comprising a beverage container having a perimeter cavity filled with a refrigerant gel, having a series of generally vertically extending ribs projecting radially out from an exterior perimeter wall defining in part said perimeter cavity, said ribs providing a gripping surface for a person holding said drinking vessel.

2. The drinking vessel according to claim 1 wherein said ribs are narrow in thickness, and are substantially more widely separated than the thickness thereof.

3. The drinking vessel according to claim 1 wherein said drinking vessel includes an inner beverage container piece nested into an outer holder piece, said cavity defined therebetween, said ribs formed on said holder piece.

4. The drinking vessel according to claim 3 wherein said ribs taper down in height towards the bottom of said holder piece.

5. The drinking vessel according to claim 3 wherein holder piece is shorter than said beverage container piece, which projects above said holder piece.

6. The drinking vessel according to claim 5 wherein said beverage container piece is constructed of a clear plastic while said holder piece is constructed of a colored plastic.

7. The drinking vessel according to claim 5 wherein a shoulder is formed in said container piece, said shoulder abutted by a top rim of said holder piece, and permanently joined thereto.

8. The drinking vessel according to claim 7 wherein said beverage container piece has a bottom wall spaced above a bottom wall of said holder piece to define a cavity portion extending between said bottom walls, said cavity portion also filled with a refrigerant gel.

* * * * *